US006711098B2

(12) United States Patent
Berard

(10) Patent No.: US 6,711,098 B2
(45) Date of Patent: Mar. 23, 2004

(54) DEVICE DISPLAYING CALENDAR DATE

(75) Inventor: Vincent Berard, La Chaux-de-Fonds (CH)

(73) Assignee: Vaucher Manufacture Fleurier S.A., Fleurier (CH)

( * ) Notice: Subject to any disclaimer, the term of this patent is extended or adjusted under 35 U.S.C. 154(b) by 0 days.

(21) Appl. No.: 10/296,017

(22) PCT Filed: May 11, 2001

(86) PCT No.: PCT/IB01/00814

§ 371 (c)(1),
(2), (4) Date: Nov. 13, 2002

(87) PCT Pub. No.: WO01/90825

PCT Pub. Date: Nov. 29, 2001

(65) Prior Publication Data

US 2003/0112707 A1 Jun. 19, 2003

(30) Foreign Application Priority Data

May 25, 2000 (EP) ..... 00111224

(51) Int. Cl.[7] ..... G04B 19/20; G04B 19/24
(52) U.S. Cl. ..... 368/28; 368/37
(58) Field of Search ..... 368/28, 31–38

(56) References Cited

U.S. PATENT DOCUMENTS 3,910,362 A * 10/1975 Piguet ..... 368/104
5,014,251 A * 5/1991 Groothuis et al. ..... 368/80

FOREIGN PATENT DOCUMENTS

CH 310559 10/1955
EP 0 619 035 B1 6/1993

* cited by examiner

*Primary Examiner*—Vit W. Miska
(74) *Attorney, Agent, or Firm*—McGlew and Tuttle, PC

(57) ABSTRACT

Date display device, intended to be fitted to a timepiece provided with a movement, a dial 10 and hands 12, 14 driven by said movement and displaying the time. A date mechanism, drives first 32 and second 34 display members, mounted to move in rotation on the movement, and provided with indices 24 26. The device is arranged so that, when the mechanism causes the units display to pass from a value n to n+1, n being an integer number comprised between 1 and 9, the first member 32 travels, in the clockwise direction, through an angle equal to 30°, and so that, when n is equal to 1, the index 24 is located in a position corresponding to the position which an hour hand would occupy, when it is one o'clock.

15 Claims, 5 Drawing Sheets

DEVICE DISPLAYING CALENDAR DATE

BACKGROUND OF THE INVENTION

The present invention relates to date display devices intended to be fitted to timepieces of the type including a movement and hands driven by the movement and displaying the time.

In the first watches of this type, the date was displayed by an additional hand making one revolution in 31 days. One of them, dating from the 18th century, is described at page 156 of the catalogue of selected works of the International Horological Museum in La Chaux-de-Fonds (ISBN 2-940088-07-1). It was thus an analogue type display. Such a solution is simple, but can only be read approximately, since the angle traveled by the hand each day is insufficient to allow two neighboring positions to be differentiated at a glance.

In most of the watches currently marketed, for example those shown at page 281 of the aforementioned catalogue, the display occurs in a digital manner, by means of a disc bearing the numbers from 1 to 31 and jumping forward each day. The date appears in a window made in the dial. The figures displaying this information have to be of small dimensions, and are thus difficult to read.

One solution to this problem consists in providing the device with first and second display members mounted so as to move in rotation on the movement, arranged under a dial provided with apertures. These members are respectively intended to display the units and the tens of the date by means of figures, visible through the apertures. The device further includes a drive and positioning mechanism controlled by the movement and arranged so as to cause one or the other or both of the members to jump forward once a day.

Such a device is, for example, disclosed in Swiss Patent No. 310 559. This device is controlled by a clockwork movement, by means of a wheel making a revolution in 24 hours. The latter drives through 1/31st of a revolution, and once a day, a wheel assembly including two superposed wheels. The display members are formed of two discs arranged side by side, one displaying the tens of the date and the other the units, the current date appearing in an aperture of the dial.

The wheel assembly and the discs are arranged so that, when the units figure of the date displayed is equal to 0 or comprised between 2 and 8, only the units disc is driven, when the units figure is equal to 9, the units and the tens discs are both driven, when the units figure is equal to 1 and the tens figure to 0, 1 or 2, only the units disc is driven, and when the units figure is equal to 1 and the tens figure to 3, only the tens disc is driven. Such a device allows the date to be displayed by means of figures of large dimensions.

It is evident that the date is easier to read, but less aesthetically pleasing, the more apparent it is, since the figures overload the dial.

Another solution is disclosed in European Patent No. 0 619 035. It relates to an electronic watch of the analogue type, wherein the date is displayed by means of two hands. The first indicates the tens, in four positions making an angle of 90° between them, while the second displays the units, in ten positions regularly distributed over one revolution.

This solution can only be envisaged insofar as figures are located facing the position of the hands. This is necessary to permit reading, since the hands do not occupy a usual position for a given value, as is the case of the hour and minute display. This solution thus loads the dial considerably, without however making it simple to read.

The object of the present invention is to allow a display of the date in a particularly readable manner while contributing to the aesthetic appearance of the timepiece.

SUMMARY OF THE INVENTION

Therefore, the display device according to the invention, which is intended to be fitted to a timepiece of the type including a movement, a dial and hands, the latter being driven by the movement and displaying the time, includes first and second display members, driven in rotation by the movement, intended to display respectively the units and the tens of the date, and a drive and positioning mechanism controlled by the movement and arranged so as to cause one or the other or both of the display members to jump forward once a day. It is characterized in that the first member is mounted on the movement, pivoting about an axis which is perpendicular thereto and bears an index, and in that the mechanism and the first member are arranged so that, when the mechanism causes the display of the units of the date to pass from a value n to n+1, n being an integer number comprised between 1 and 9, the first member travels, in the clockwise direction, through an angle equal to 30°, and in that, when n is equal to 1, the index is located in a position corresponding to the position which an hour hand, pivoting about the axis of the first member, would occupy, when it is one o'clock.

In order to assure the passage from 9 to 0, the mechanism and the first member are arranged so that the latter performs a jump of 90° when n is equal to 0, so that the index passes from the <<nine o'clock>> position to the <<midday>> position, via the shortest route.

In a particularly advantageous embodiment, the first member is formed of a disc, bearing the index, and placed underneath the dial. The latter includes nine apertures disposed in an arc of a circle substantially concentric with the disc, the first aperture occupying a position corresponding to <<1 o'clock>> and the following ones making an angle of 30° with respect to each other, with reference to the central point of the arc of the circle, so that the last aperture is located in the <<9 o'clock>> position, so that altogether the index of the first member is visible through the apertures.

If, in order to display the units, it seems advantageous to use an index whose position corresponds to that of an hour hand, the situation is different for the indication of the tens. Indeed, perception of a number of objects comprised between 0 and 3 occurs without any problem and at first glance. This is why, advantageously, the second display member is also formed of a disc mounted so as to pivot on the movement and which bears three indices disposed in an arc of a circle, and the dial includes three apertures which are also disposed in an arc of a circle and of the same radius as the arc formed by the indices. Further, the tens display member and the drive and positioning mechanism are arranged so that zero, one, two or the three indices are visible through the three apertures, depending upon whether the figure of the tens is equal to 0, 1, 2 or 3.

An aesthetically pleasing display requires precise positioning of the discs. This is why it is advantageous for the mechanism to include two star wheels with twelve teeth, respectively secured to the first and second members and each cooperating with a jumper spring to position it.

In order to permit an optimum drive which only requires a correction for the months of less than 31 days, the mechanism and the display members are arranged so that, when the units figure of the date is equal to 0 or comprised between 2 and 8, only the units disc is driven, when the units figure is equal to 9, the units and tens discs are both driven, when the units figure is equal to 1, and the tens figure to 0, 1 or 2, only the units disc is driven, and when the units figure is equal to 1 and the tens figure to 3, only the tens disc is driven.

In order to assure optimum driving of the device, the mechanism further includes:

a <<24 hour>> wheel, completing one revolution per day, driven by said movement, and carrying a drive finger, a lever, mounted so as to pivot on the movement, actuated by said drive finger and cooperating with a return spring, provided with first, second, third and fourth drive means and positioning means, the first drive means cooperating with the star wheel with twelve teeth secured to the first member and causing it to move forward by one step each day, a date wheel assembly including a date star-wheel, with 31 teeth, making one step per day via the action of second drive means, and a day cam, cooperating with the lever positioning means and defining three levels, the first, upper, level, corresponding to the position occupied by the date wheel assembly on the 31st of the month, the second, median, level corresponding to the positions occupied by the date wheel assembly when the units figure of the date is equal to zero, or comprised between 2 and 8, or when the units figure is equal to 1 and the tens figure to 0, 1 or 2, and the third, lower, level, corresponding to the position occupied by the date wheel assembly when the units figure is equal to 9, a drive flirt for the star wheel with twelve teeth secured to the second member, provided with a star wheel with ten teeth and driven through one step per day by the third drive means of the lever, with the exception of the day when the positioning means abut against the upper level of the cam, and arranged so that the flirt is released when the units figure of the date is equal to 9, a retrograde unit for the tens including a star wheel with 31 teeth, kinematically connected to the star wheel with 31 teeth of the date wheel assembly, released when the lever positioning means abut against the upper level of said cam, a return spring of the second member, wound each time that the drive flirt moves the second member forward and let down when the retrograde unit is released, and a drive lever, secured in rotation to the first member and cooperating with the fourth drive means, to cause the star wheel with twelve teeth secured to the first member to move forward three steps each time that the lever positioning means abut against the lower level of the cam.

BRIEF DESCRIPTION OF THE DRAWINGS

Other features and advantages of the invention will appear from the following description, made with reference to the annexed drawing, in which.

DESCRIPTION OF THE PREFERRED EMBODIMENT

Figure 1:
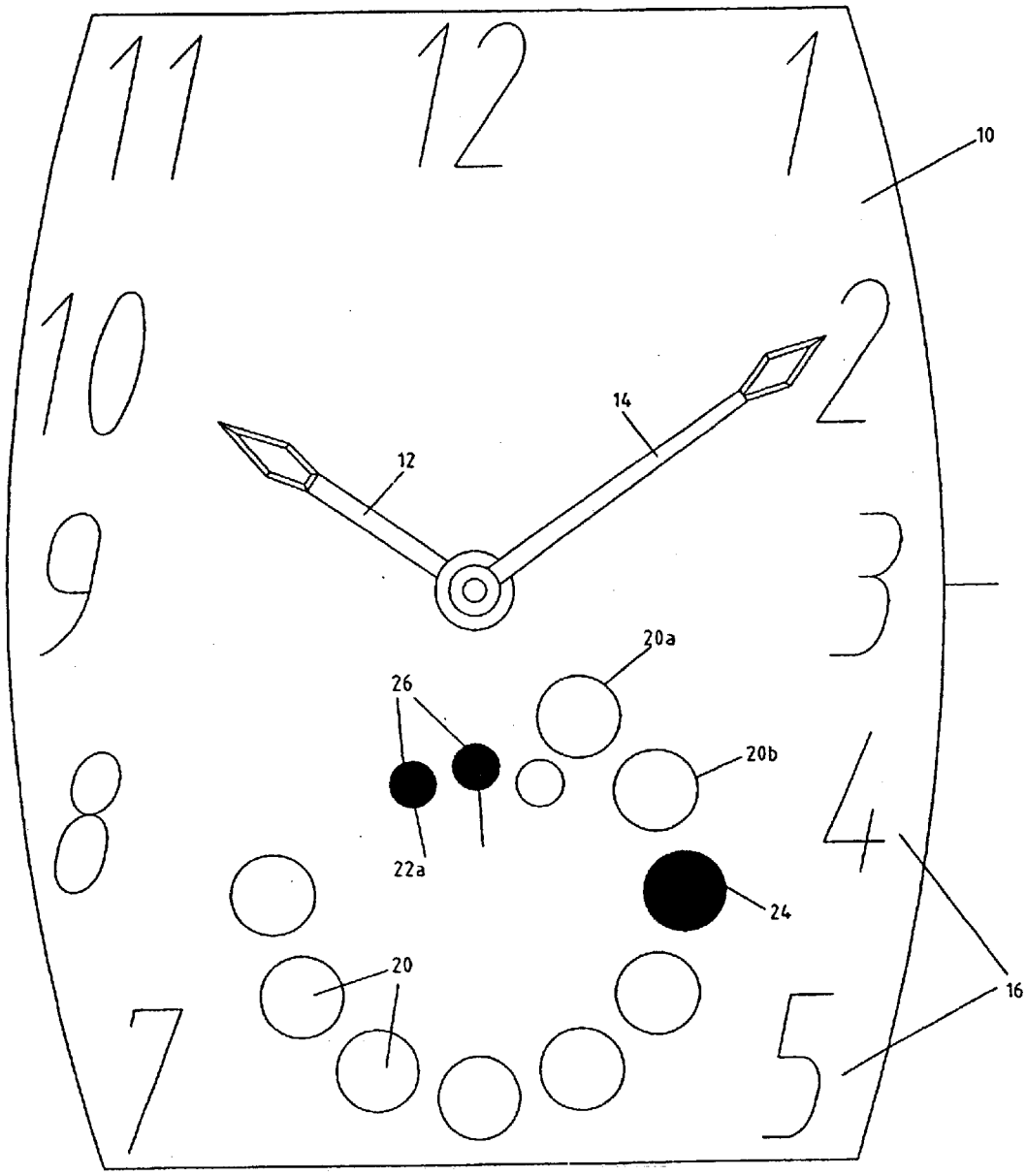
FIGS. 1 and 2 show two alternative arrangements of the display members.
Figure 2:
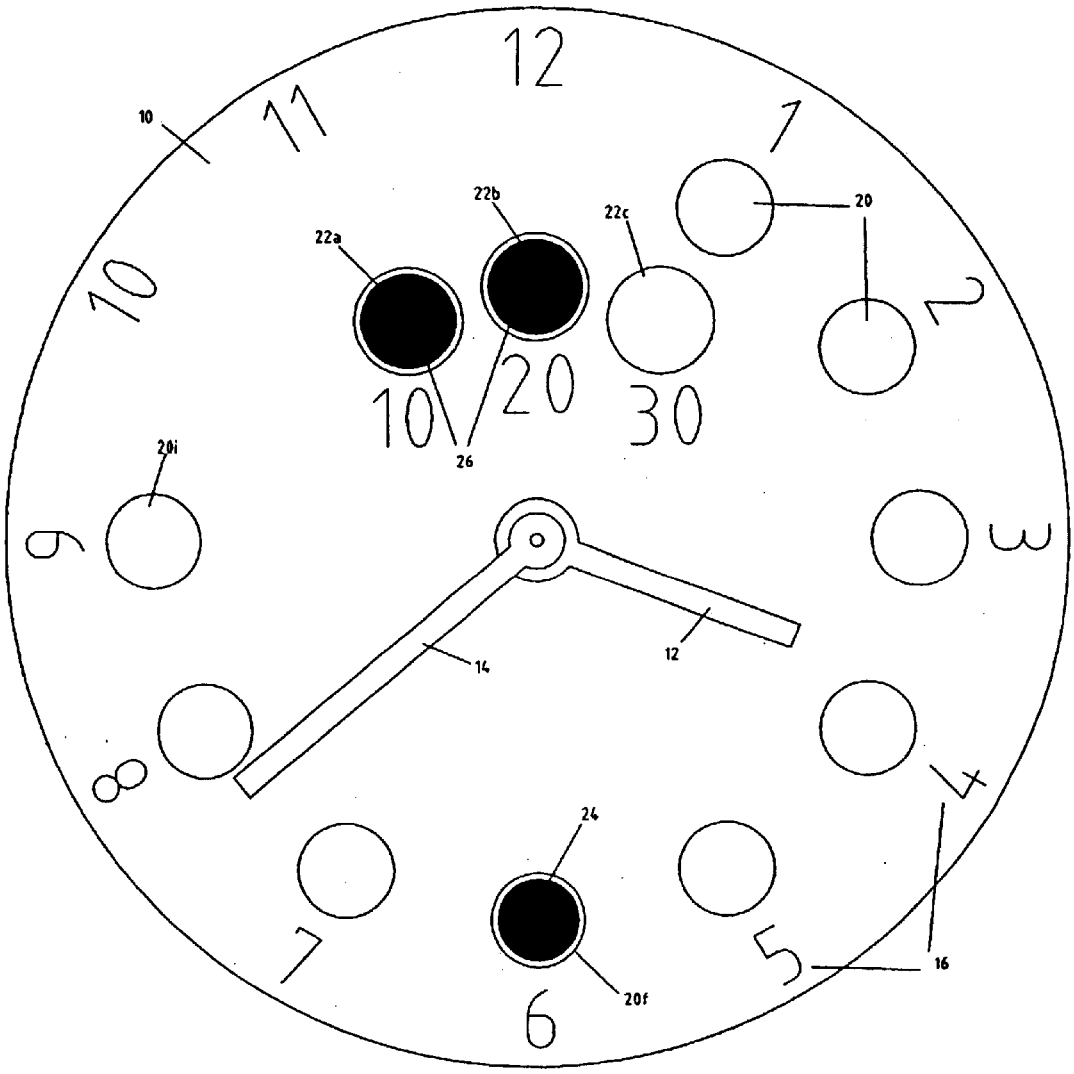

The watches, shown schematically in FIGS. 1 and 2, include, in a conventional manner, a dial 10 and, placed in front of this dial, hands 12 and 14 respectively displaying the hours and the minutes.

In FIG. 1, the watch is barrel-shaped. Its dial carries an hour-circle 16 formed of numbers from 1 to 12, except 6. It is also provided with a set of nine apertures 20 intended to display the units of the date, and a set of three apertures 22 for the display of the tens of the date, respectively disposed on two concentric circles occupying the space comprised between the center and the 6 o'clock position of the dial.

In this watch, the date display is achieved by means of an index 24, intended to indicate the value of the units figure by its position and three indices 26, intended to display the tens figure, the latter being equal to the number of indices visible.

The apertures 20 define between them an angle of 30°, namely the angle which the hour hand travels in an hour. In other words, if an hour hand pivoted at the center of the concentric circles, it would be located, facing aperture 20*a* at 1 o'clock, second aperture 20*b* at 2 o'clock etc.

Index 24 appears through one of apertures 20 and indicates the units figure of the date by its position, the latter being equal to 3 in FIG. 1. Two of indices 26 are visible through the first two apertures 22*a* and 22*b*, to indicate that the tens figure is equal to 2. In other words, the current date is equal to 23.

Figure 4:
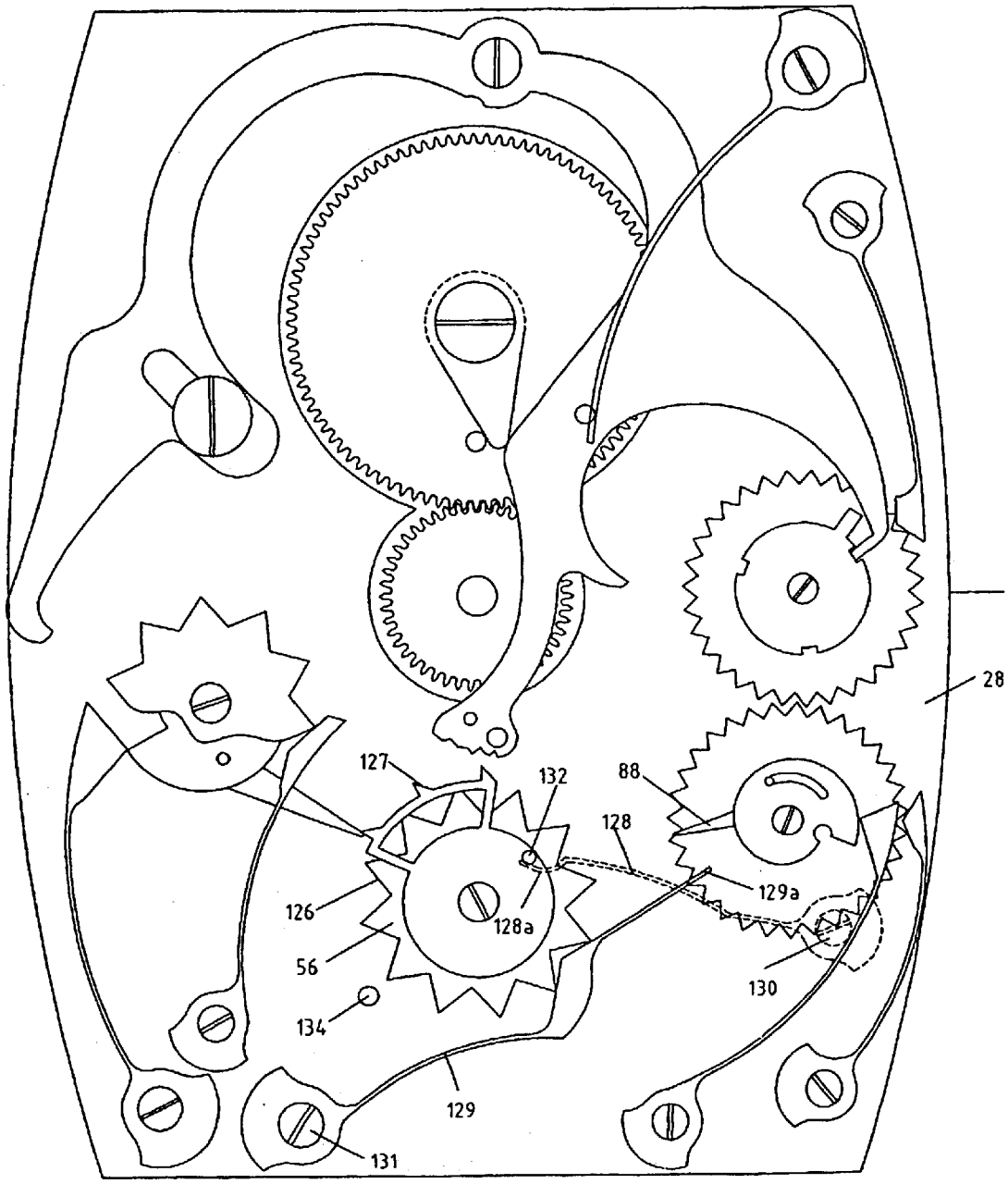
Figure 5:
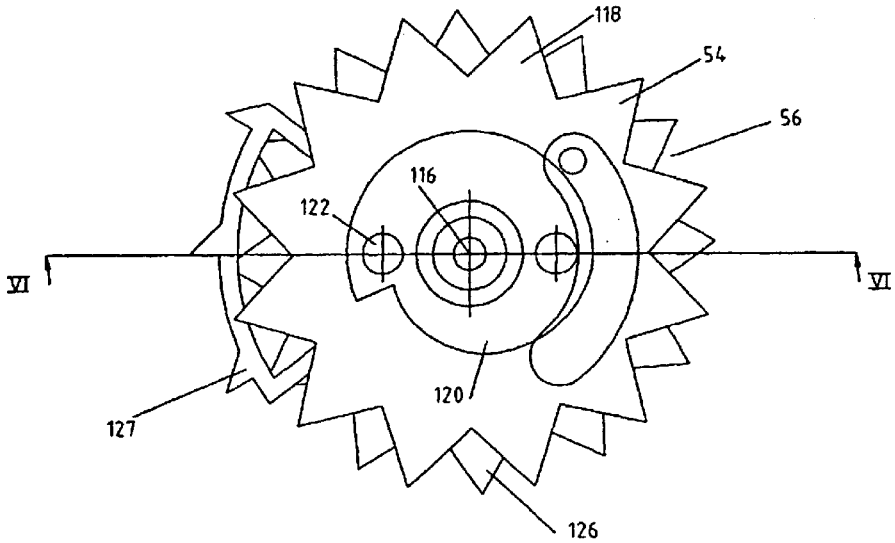
FIGS. 5 and 6 are respectively plan and cross-sectional views of a part of this mechanism.
Figure 6:
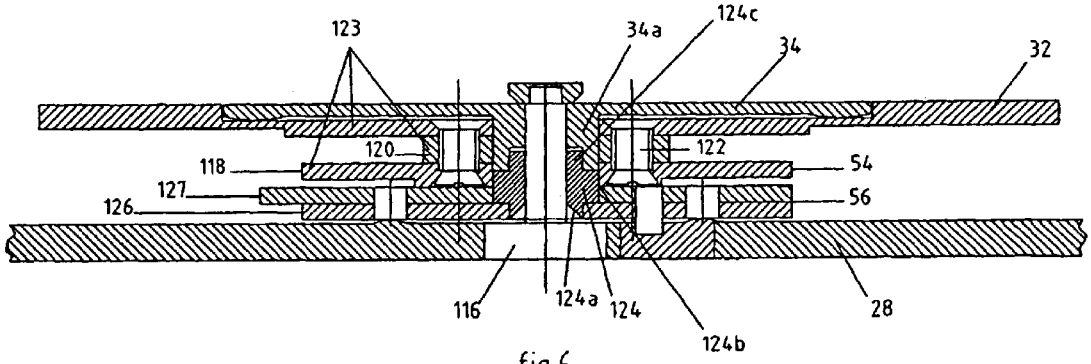

In the embodiment of FIG. 2, apertures 20 are located facing the FIGS. 1 to 9 of hour circle 16, aperture 20*f*, next to the FIG. 6, framing index 24. The units figure is thus equal to 6.

Apertures 22 are arranged in the zone comprised between 11 o'clock and 1 o'clock, two indices 26 appearing in apertures 22*a* and 22*b*. The tens figure is thus equal to 2. In this case, the date displayed is thus equal to 26.

In the two examples described above, cut out portions 20 and 22 are round. It is evident that they may have other shapes. Thus, in the case of the example of FIG. 2, these apertures could also, advantageously, have the shape of the figure corresponding to its position and thus replace hour circle 16.

Figure 3:
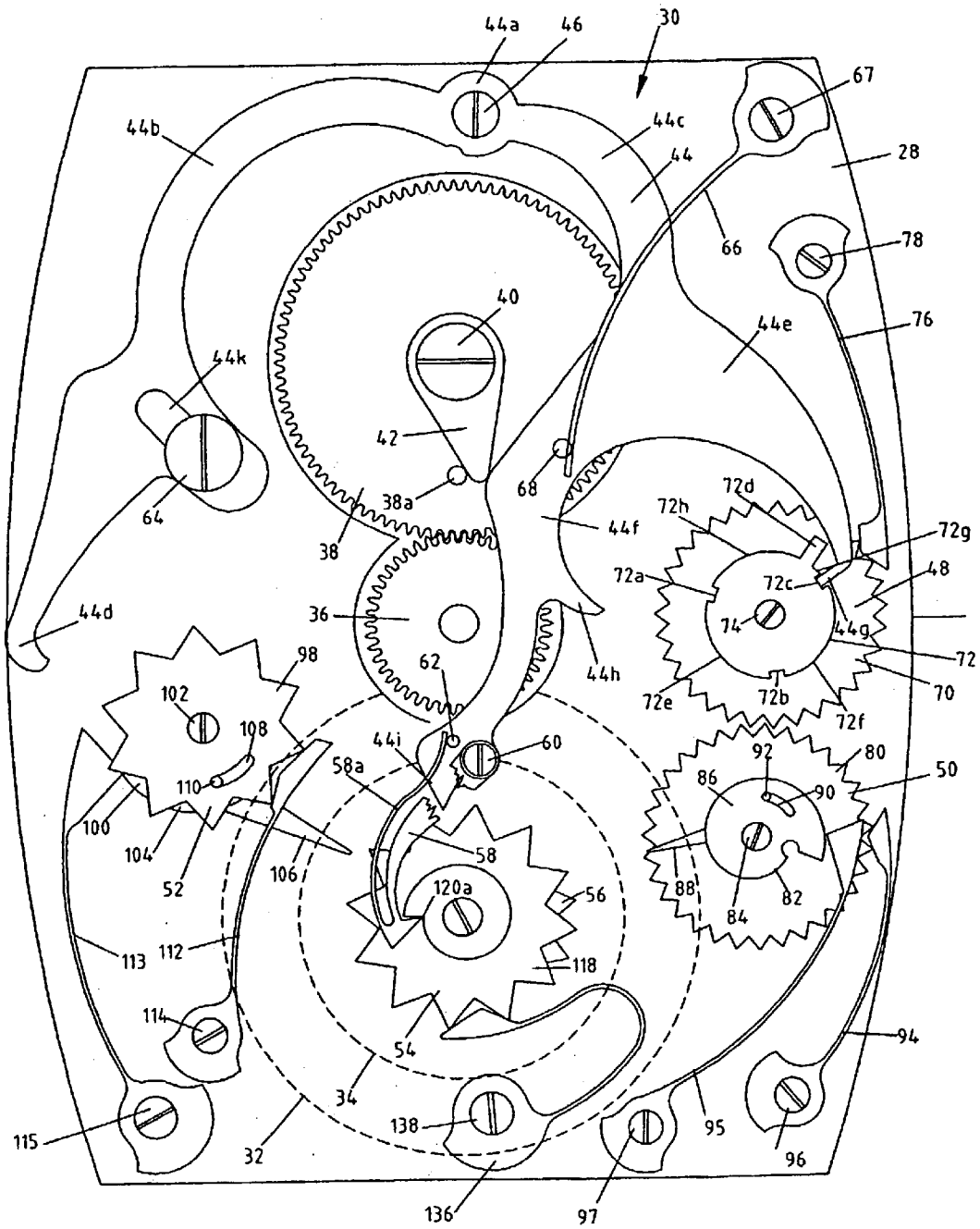
FIGS. 3 and 4 show the drive mechanism for a display of the 29th of the month, certain parts having been removed in FIG. 4, to facilitate comprehension of the invention.

FIGS. 3 and 4 show a watch movement, displaying the date according to the embodiment of FIG. 1, the components of which occupy their position corresponding to the 29th of the month. These Figures differ in the masking or removal of all or part of certain parts.

The movement includes a plate 28 on which a drive mechanism 30 is mounted and concentric discs 32 and 34, shown in a dotted line in FIG. 3 and bearing respectively index 24 and the three indices 26, which are not shown in this Figure.

The watch movement further includes a time base and a gear train, which are not visible in the drawing, since they are located on the other side of plate 28, with the exception of hour wheel 36 disposed at the center of the movement and intended to carry hour hand 12.

Mechanism 30 is connected to hour wheel 36 by a <<24 hour>> wheel 38, completing one revolution per day, and mounted so as to pivot on plate 28, on a stud which is not visible in the drawing, and held axially by means of a screw 40. A finger 42, coaxial with wheel 38, is secured, in rotation, to wheel 38, by a pin 38*a* driven into the plate of wheel 38 and abutting against finger 42.

Mechanism 30 includes, distributed over the periphery of the plate and considered in the clockwise direction, from the <<midday>> position, a lever 44 mounted so as to pivot and secured in proximity to <<midday>> by means of a screw 46, a date wheel assembly 48 disposed in proximity to <<3 o'clock>>, a retrograde tens unit 50 placed in proximity to <<4 o'clock>>, a units wheel assembly 54 and a tens wheel assembly 56, coaxial and located at <<6 o'clock>>, and a tens unit 52, which is located in proximity to <<8 o'clock>>.

More precisely, lever 44 includes a bulge 44*a* pierced by a hole in which screw 46 is engaged. It is formed of first and second arms 44*b* and 44*c*, disposed on either side of bulge 44*a*. Arm 44*b* forms, at its free end, a finger 44*d* intended to cooperate with unit 52.

Second arm 44*c* is provided with a fork with two teeth 44*e* and 44*f*. Tooth 44*e* ends in a finger 44*g* intended to cooperate with wheel assembly 48. Tooth 44*f* includes, in its median part, a snug 44*h* intended to cooperate with date wheel assembly 48. It forms, at its free end, a finger 44*i* intended to cooperate with units wheel 54 and further carries a drive lever 58. The latter is mounted so as to pivot by means of a screw 60 and is provided with a spring 58*a* abutting against a pin 62 disposed on tooth 44*f*. Spring 58*a* generates a force intended to apply lever 58 against units wheel set 54, as will be specified hereinbelow.

Lever 44 has to be held in place so that it remains in a plane perpendicular to the pivoting axis. Therefore, arm 44*b* includes a cut out portion 44*k*, in an arc of a circle, the center of which coincides with the axis of screw 46; a screw 64 with a shoulder is engaged therein and limits axial movements.

A lever spring 66, secured by means of a screw 67 on the periphery of the plate, in proximity to <<1 o'clock>>, cooperates with a pin 68 secured to tooth 44*f* and generates a torque tending to cause lever 44 to rotate in the clockwise direction. The latter is thus held in the rest position, as seen in FIGS. 3 and 4, finger 44*g* abutting against date wheel assembly 48.

Date wheel assembly 48 includes, superposed, a star wheel with 31 teeth 70 and a cam 72, secured to each other in rotation. It pivots on a stud of plate 28, which is not visible in the drawing, on which it is held axially by means of a screw 74. Star wheel 70 is provided with a toothing of triangular profile, disposed in the same plane as snug 44*h* and on its path, so that, each day at midnight, this snug causes wheel assembly 48 to move forward by one step. The latter thus makes one revolution per month. A jumper spring 76, secured by means of a screw 78 to the periphery of plate 28, in proximity to <<2 o'clock>>, cooperates with the toothing of star wheel 70 to position wheel assembly 48.

Cam 72 has three radial levels, with three cut out portions or notches 72*a*, 72*b* and 72*c* defining a lower level, corresponding to the passages of the date to a higher ten, a protrusion 72*d* defining an upper level and corresponding to the passage from the 31st to the 1st of the month, and four surfaces in a portion of a circle 72*e* to 72*h*, disposed between the notches and the protrusion and defining an intermediate level, corresponding to the other days of the date. It is located at the same level as finger 44*g* and acts as a support for lever 44 in the rest position.

Retrograde tens unit 50 includes a star wheel with 31 teeth 80 provided with a toothing of triangular profile meshed with the toothing of star wheel 70, and a cam 82 disposed above star wheel 80. Like wheel assembly 48, it completes one revolution per month. It pivots on a stud of plate 28, which is not visible in the drawing, on which it is held axially by means of a screw 84 defining its pivoting axis.

Cam 82 is formed of a snail shaped part 86 and a finger 88 which are superposed and secured to each other in rotation. Snail shaped part 86 includes a circular cut out portion 90, in which a pin 92, secured to star wheel 80, is engaged. Pin 92 assures the connection between star wheel 80 and cam 82, so that, each time that star wheel 80 moves forward, it drives with it cam 82. Because of cut out portion 90, in which pin 92 is engaged, finger 88 and snail shaped part 86 can have a relative movement of approximately 450.

Retrograde tens unit 50 cooperates with a jumper spring 94 and a flirt 95, respectively secured by means of screws 96 and 97, between <<5 o'clock>> and <<6 o'clock>>. Jumper spring 94 is engaged in the toothing of star wheel 80, to position it. Flirt 95 abuts against snail shaped part 86, to control the backward movement of the tens as will be explained hereinbelow.

Tens unit 52 includes a star wheel with ten teeth 98 and a cam 100. Star wheel 98 includes a triangular toothing disposed at the same height as finger 44*d* with which it cooperates, so as to cause it to move forward by one step each day. It thus completes one revolution in ten days. Unit 52 is mounted so as to pivot on a stud of plate 28, which is not visible in the drawing, on which it is held axially by means of a screw 102.

Cam 100 is formed of a snail shaped part 104 and a finger 106 which are superposed and secured to each other in rotation. Star wheel 98 includes a circular cut out portion 108, in which a pin 110, secured to snail shaped part 104, is engaged. Pin 110 assures the connection between star wheel 98 and cam 100, so that, each time that star wheel 98 moves forward, it drives with it cam 100. Because of cut out portion 108, in which pin 110 is engaged, finger 106 and snail shaped part 104 can have a relative movement of approximately 45°.

Tens Unit 52 cooperates with a jumper spring 112 and a flirt 113, secured respectively to the periphery of the plate, in proximity to <<7 o'clock>>, by means of screws 114 and 115. Jumper spring 112 is engaged in the toothing of star wheel 98 and intended to position it. Flirt 113 abuts against snail shaped part 104 to control the jumping forward of the tens, as will be explained hereinbelow.

FIGS. 5 and 6 show, in detail, wheel assemblies 54 and 56, as well as, in FIG. 6 only, discs 32 and 34 which are respectively associated therewith. More precisely, FIG. 5 is a top view and FIG. 6 a cross-section along the line VI—VI of FIG. 5.

As can be see in these Figures, wheel assemblies 54 and 56 are coaxial, mounted so as to pivot on a stud 116 driven into plate 28. They are arranged so that they can rotate freely with respect to each other.

More precisely, units wheel assembly 54 includes a star wheel with twelve teeth 118 and a snail shaped part 120, which are superposed and connected to each other and to the units disc 32, disposed above snail shaped part 120, by means of two screw studs 122.

Star wheel 118 includes a toothing of triangular profile disposed in the same plane as finger 44*i* and on its path, so as to be driven by one step per day.

Snail shaped part 120 is located in the same plane as drive lever 58, with which it cooperates at the end of each day whose date ends in <<9>>, as will be explained hereinbelow.

Star wheel 118, snail shaped part 120 and disc 32 are pierced with central circular holes of the same diameter, which together form a bearing 123.

Tens wheel assembly 56, which carries disc 34, is formed of a pipe 124, mounted so as to pivot on stud 116, a star wheel with twelve teeth 126, of triangular profile, riveted onto pipe 124, and a rack 127, secured in rotation to star wheel 126.

In order to assure the securing thereof to pipe 124, disc 34 includes, on its bottom face, a socket 34*a* engaged in bearing 123.

Pipe 124 includes three cylindrical portions 124*a*, 124*b* and 124*c*. Portion 124*a*, adjacent to plate 28, carries star wheel 126. Portion 124*b*, which is intermediate and of larger diameter acts as a pivot for bearing 123. It is of the same diameter as socket 34*a*. Finally, portion 124*c* is driven into socket 34*a*, to secure disc 34 and wheel assembly 56 rigidly to each other, the assembly formed by disc 32 and wheel assembly 54 being imprisoned therein.

As FIG. 4 shows, a spring 128 and jumper spring 129 cooperate with wheel assembly 56. They are respectively secured to the periphery of the plate by means of screws 130 and 131, spring 128 in proximity to <<4 o'clock>>, jumper spring 129 in proximity to <<7 o'clock>>. Star wheel 126 carries a pin 132, disposed at the same height as spring 128 and abutting against its end 128*a*.

A pin 134, driven into plate 28, acts as a stop for rack 127 when the latter reaches the end of its travel.

Jumper spring 129 is engaged in the toothing of star wheel 126. It is extended by a stem 129*a* which is located in the space swept by finger 88.

In order to understand how wheel assembly 54 is positioned, reference must be made to FIG. 3, which shows a jumper spring 136 meshed with the toothing of star wheel 118. Jumper spring 136 is secured to plate 28 by means of a screw 138 disposed in proximity to 6 o'clock.

In the preceding description, the different jumper springs and flirts have been described as being secured to the plate by means of screws. It goes without saying that, to guarantee precise positioning, it is advantageous to arrange pins in the plate and to provide each of the jumper springs and flirts with holes in which the pins engage. This method is well known to those skilled in the art, which is why it has not been shown, to avoid overloading the drawing.

Mechanism 30, as it has just been described, includes three operating sequences, defined by the initial position of lever 44, abutting against cam 72.

Every day, with the exception of the 9th, 19th, 29th and 31st of the month, finger 44*g* of lever 44 rests on the median level of the cam, defined by sectors 72*e* to 72*h*. On the 9th, 19th and 29th, it is engaged respectively in notches 72*a*, 72*b* and 72*c*. Finally, on the 31st, finger 44*g* abuts against protrusion 72*d*. These different situations will be examined in succession hereinbelow.

For more than twenty hours, <<24 hour>> wheel 38 rotates freely, driving finger 42, via pin 38*a*. During this time, lever 44 is in the rest position, defined by finger 44*g* abutting against cam 72. Mechanism 30 is then stationary.

Around 22 hours, finger 42 comes into contact with lever 44, abutting in the forking zone of arm 44*c*, and more particularly against the wall of tooth 44*f*. The lever then pivots slowly at 44*a*, in the anti-clockwise direction, winding spring 66, such that it exerts a counter-reaction force on finger 42.

When finger 44*g* abuts against the median portion of cam 72, and just before the counter-reaction force passes through the axis of screw 40, fingers 44*d*, 44*i* and snug 44*h* respectively come into contact with the toothings of star wheels 70, 98 and 118, making all three move forward one step.

Since disc 32 is secured in rotation to star wheel 118, index 24, carried by disc 32 consequently passes from one aperture 20 to the other by one step per day, until it reaches aperture 20*i*, located at 9 o'clock, which indicates that the units of the date are equal to 9.

After the counter-reaction force has passed the axis of screw 40, it generates a torque on finger 42 tending to move it away from pin 38*a*. Lever 44 then pivots in the clockwise direction, driven by the force exerted by spring 66, until finger 44*g* comes into contact with cam 72 again. If the date of the next day is different from 9, 19, 29 or 31, the finger comes to abut in the median portion of cam 72. Consequently, some 20 hours later, the same chain of events reoccurs.

If, conversely, the units figure of the date of the next day is equal to 9, finger 44*g* then engages in one of bottom notches 72*a*, 72*b* or 72*c*. Moreover, units wheel assembly 54 has rotated so that drive lever 58 is caught on the connection plane 120*a* of the two ends of the spiral of snail shaped part 120.

When finger 42 comes into contact with lever 44 located in this position, its movement begins by making wheel assembly 54 rotate, successively through three times 30°, so that units index 24 is located in the midday position of the dial. Since the latter does not include an aperture at this location, the index is thus masked, thereby indicating that the units figure is equal to 0.

Further, as previously explained, snug 44*h* drives the toothing of star wheel 70, while finger 44*d* causes the toothing of star wheel 98 also to move forward by one step and, with it, cam 100.

The latter is disposed so that flirt 113 then passes the outer end of snail shaped part 104 and causes the abrupt displacement of cam 100, so that finger 106 drives a tooth of rack 127. Tens wheel assembly 56 thus moves forward by one step and an additional index 26 is visible through tens apertures 22.

After the counter-reaction force has passed the axis of screw 40, lever 44 fall again and abuts a median portion of cam 72. The next day, the operation thus corresponds to what was previously described, the index reappearing in aperture 20*a* to indicate that the units figure is equal to 1.

During the passage from the 31st to the first of the following month, units disc 32 and tens unit 52 must remain in the positions which they occupy and the tens disc must move backwards so that tens indices 26 disappear.

These conditions are satisfied owing to the fact that the amplitude of the movement of lever 44 is reduced, finger 44*g* abutting against protrusion 72*d*. Consequently, the movement of fingers 44*d* and 44*i* is insufficient to drive the toothings of star wheels 98 and 118. In other words, only snug 44*h* works normally, and causes the toothing of star wheel 70 to jump forward by one step. This toothing drives with it star wheel 80 and snail shaped part 86, which reaches a position such that flirt 95 passes the top end of snail shaped part 86.

This results in a torque which causes an abrupt rotation of snail shaped part 86 and finger 88. The latter raises stem 129*a*. Jumper spring 129 is then released from star wheel 126. Spring 128 is no longer held, so that it causes star wheel 126 to rotate in the anti-clockwise direction, over an angle of 90°. In this position, the three indices 22 are masked by the dial, the tens figure of the date being thus equal to zero.

The device according to the invention may, of course, be the subject of numerous variants. It is possible in particular to associate therewith a rapid correction mechanism, controlled in a conventional manner by a time-setting stem.

It is also possible to associate therewith control means of the type fitted to perpetual calendar watches. In this case, the month could be indicated by another index, advantageously less apparent than the index of the first member, moving facing the hour circle. Consequently, this other index would face the 1 in January, the 2 in February, etc.

I claim:

1. A date display device provided with a movement, for fitting to a timepiece, the display device comprising:

a dial and hands driven by the movement and displaying the time;

first and second display members, mounted to move in rotation on the movement, said members displaying respectively the units and the tens of the date;

a drive and positioning mechanism controlled by the movement and arranged so as to cause one or the other or both of said display members to jump forward once a day, wherein said first member bears an index and wherein said mechanism and said first member are arranged so that when said mechanism causes said display of the units of the date to pass from a value n to n+1, n being an integer number comprised between 1 and 9, said first member travels, in a clockwise direction, through an angle equal to 30°, and wherein when n is equal to 1, said index is located in a position corresponding to a position which an hour hand would occupy when it is one o'clock.

2. A date display device according to claim 1, wherein said mechanism and said first member are arranged so that said first member makes a jump of 90° when n is equal to 9, so that said index passes from a "nine o'clock" position to a "midday" position.

3. A date display device according to claim 2, wherein said first member is formed of a disc bearing said index and placed behind said dial, and wherein said dial includes nine apertures disposed in an arc of a circle substantially concentric with said disc, said apertures including a first aperture occupying a position corresponding to "1 o'clock" and other of said apertures making an angle of 30° with respect to each other, with reference to a central point of an arc of a circle, so that a last aperture is located at said "9 o'clock" position, so that altogether said index of said first member is visible through said apertures.

4. A date display device according to claim 3, wherein said second display member is formed of a second disc, carrying three indices disposed in an arc of a circle, wherein said dial further includes three apertures, also disposed in an arc of a circle concentric with and of a same radius as said arc formed by said indices and wherein said second display member and said drive and positioning mechanism are arranged so that none, one, two or three of said indices are visible through three apertures, according to whether said tens figure of the date is equal to 0, 1, 2 or 3.

5. A date display device according to claim 4, wherein said mechanism and said members are arranged so that, when said units figure of the date displayed is equal to 0 or comprised between 2 and 8, only said units disc is driven, when said units figure is equal to 9, said units disc and said tens disc are both driven, when said units figure is equal to 1, and said tens figure to 0, 1 or 2, only said units disc is driven, and when said units figure is equal to 1 and said tens figure to 3, only said tens disc is driven.

6. A date display device according to claim 1, wherein said mechanism includes two wheels with twelve teeth respectively secured to said first and second members and each cooperating with a jumper spring to position it.

7. A date display device according to claim 6, wherein said mechanism further includes:

a "24 hour" wheel, completing one revolution per day, driven by said movement, and carrying a drive finger;

a lever, mounted so as to pivot on said movement, actuated by said drive finger and cooperating with a return spring, provided with first, second, third and fourth drive means and positioning means, said first drive means cooperating with a star wheel with twelve teeth secured to said first member and causing it to move forward by one step each day;

a date wheel assembly including a date wheel with 31 teeth, making one step per day via action of said second drive means, and a day cam, cooperating with said lever positioning means and defining three levels, a first upper level, corresponding to a position occupied by said date wheel assembly on the 31st of the month, a second median level corresponding to positions occupied by said date wheel assembly when the units figure of the date is equal to zero, or comprised between 2 and 8, or when the units figure is equal to 1 and the tens figure to 0, 1 or 2, and a third lower level, corresponding to a position occupied by the date wheel assembly when the units figure is equal to 9;

a drive unit for said wheel with twelve teeth secured to said second member, provided with a drive finger and a star wheel with ten teeth and driven by one step per day by said third drive means of said lever, with the exception of the day when said positioning means abut against said upper level of said cam, and arranged so that said finger drives said wheel with twelve teeth secured to said second member when the units figure of the date is equal to 9;

a retrograde unit for the tens including another wheel with 31 teeth, kinematically connected to said wheel with 31 teeth of the date wheel assembly, actuated when said lever positioning means abut against said upper level of said cam;

a return spring of said second member, wound each time that said drive unit moves said second member forward and let down when said retrograde unit is actuated; and a drive lever, secured in rotation to said first member and cooperating with said fourth drive means, to cause said wheel with twelve teeth secured to said first member to move forward three steps each time that said positioning means of said lever abut against said lower level of said cam.

8. A date display device according to claim 2, wherein said mechanism includes two wheels with twelve teeth respectively secured to said first and second members and each cooperating with a jumper spring to position it.

9. A date display device according to claim 3, wherein said mechanism includes two wheels with twelve teeth respectively secured to said first and second members and each cooperating with a jumper spring to position it.

10. A date display device according to claim 4, wherein said mechanism includes two wheels with twelve teeth respectively secured to said first and second members and each cooperating with a jumper spring to position it.

11. A date display device according to claim 5, wherein said mechanism includes two wheels with twelve teeth respectively secured to said first and second members and each cooperating with a jumper spring to position it.

12. A date display device according to claim 8, wherein said mechanism further includes:

a "24 hour" wheel, completing one revolution per day, driven by said movement, and carrying a drive finger;

a lever, mounted so as to pivot on said movement, actuated by said drive finger and cooperating with a return spring, provided with first, second, third and fourth drive means and positioning means, said first drive means cooperating with a star wheel with twelve teeth secured to said first member and causing it to move forward by one step each day;

a date wheel assembly including a date wheel with 31 teeth, making one step per day via action of said second drive means, and a day cam, cooperating with said lever positioning means and defining three levels, a first upper level, corresponding to a position occupied by said date wheel assembly on the 31st of the month, a second median level corresponding to positions occupied by said date wheel assembly when the units figure of the date is equal to zero, or comprised between 2 and 8, or when the units figure is equal to 1 and the tens figure to 0, 1 or 2, and a third lower level, corresponding to a position occupied by the date wheel assembly when the units figure is equal to 9;

a drive unit for said wheel with twelve teeth secured to said second member, provided with a drive finger and a star wheel with ten teeth and driven by one step per day by said third drive means of said lever, with the exception of the day when said positioning means abut against said upper level of said cam, and arranged so that said finger drives said wheel with twelve teeth secured to said second member when the units figure of the date is equal to 9;

a retrograde unit for the tens including another wheel with 31 teeth, kinematically connected to said wheel with 31 teeth of the date wheel assembly, actuated when said lever positioning means abut against said upper level of said cam;

a return spring of said second member, wound each time that said drive unit moves said second member forward and let down when said retrograde unit is actuated; and a drive lever, secured in rotation to said first member and cooperating with said fourth drive means, to cause said wheel with twelve teeth secured to said first member to move forward three steps each time that said positioning means of said lever abut against said lower level of said cam.

13. A date display device according to claim 9, wherein said mechanism further includes:

a "24 hour" wheel, completing one revolution per day, driven by said movement, and carrying a drive finger;

a lever, mounted so as to pivot on said movement, actuated by said drive finger and cooperating with a return spring, provided with first, second, third and fourth drive means and positioning means, said first drive means cooperating with a star wheel with twelve teeth secured to said first member and causing it to move forward by one step each day;

a date wheel assembly including a date wheel with 31 teeth, making one step per day via action of said second drive means, and a day cam, cooperating with said lever positioning means and defining three levels, a first upper level, corresponding to a position occupied by said date wheel assembly on the 31st of the month, a second median level corresponding to positions occupied by said date wheel assembly when the units figure of the date is equal to zero, or comprised between 2 and 8, or when the units figure is equal to 1 and the tens figure to 0, 1 or 2, and a third lower level, corresponding to a position occupied by the date wheel assembly when the units figure is equal to 9;

a drive unit for said wheel with twelve teeth secured to said second member, provided with a drive finger and a star wheel with ten teeth and driven by one step per day by said third drive means of said lever, with the exception of the day when said positioning means abut against said upper level of said cam, and arranged so that said finger drives said wheel with twelve teeth secured to said second member when the units figure of the date is equal to 9;

a retrograde unit for the tens including another wheel with 31 teeth, kinematically connected to said wheel with 31 teeth of the date wheel assembly, actuated when said lever positioning means abut against said upper level of said cam;

a return spring of said second member, wound each time that said drive unit moves said second member forward and let down when said retrograde unit is actuated; and a drive lever, secured in rotation to said first member and cooperating with said fourth drive means, to cause said wheel with twelve teeth secured to said first member to move forward three steps each time that said positioning means of said lever abut against said lower level of said cam.

14. A date display device according to claim 10, wherein said mechanism further includes:

a "24" wheel, completing one revolution per day, driven by said movement, and carrying a drive finger;

a lever, mounted so as to pivot on said movement, actuated by said drive finger and cooperating with a return spring, provided with first, second, third and fourth drive means and positioning means, said first drive means cooperating with a star wheel with twelve teeth secured to said first member and causing it to move forward by one step each day;

a date wheel assembly including a date wheel with 31 teeth, making one step per day via action of said second drive means, and a day cam, cooperating with said lever positioning means and defining three levels, a first upper level, corresponding to a position occupied by said date wheel assembly on the 31st of the month, a second median level corresponding to positions occupied by said date wheel assembly when the units figure of the date is equal to zero, or comprised between 2 and 8, or when the units figure is equal to 1 and the tens figure to 0, 1 or 2, and a third lower level, corresponding to a position occupied by the date wheel assembly when the units figure is equal to 9;

a drive unit for said wheel with twelve teeth secured to said second member, provided with a drive finger and a star wheel with ten teeth and driven by one step per day by said third drive means of said lever, with the exception of the day when said positioning means abut against said upper level of said cam, and arranged so that said finger drives said wheel with twelve teeth secured to said second member when the units figure of the date is equal to 9;

a retrograde unit for the tens including another wheel with 31 teeth, kinematically connected to said wheel with 31 teeth of the date wheel assembly, actuated when said lever positioning means abut against said upper level of said cam;

a return spring of said second member, wound each time that said drive unit moves said second member forward and let down when said retrograde unit is actuated; and a drive lever, secured in rotation to said first member and cooperating with said fourth drive means, to cause said wheel with twelve teeth secured to said first member to move forward three steps each time that said positioning means of said lever abut against said lower level of said cam.

15. A date display device according to claim 11, wherein said mechanism further includes:

a "24 hour" wheel, completing one revolution per day, driven by said movement, and carrying a drive finger;

a lever, mounted so as to pivot on said movement, actuated by said drive finger and cooperating with a return spring, provided with first, second, third and fourth drive means and positioning means, said first drive means cooperating with a star wheel with twelve teeth secured to said first member and causing it to move forward by one step each day;

a date wheel assembly including a date wheel with 31 teeth, making one step per day via action of said second drive means, and a day cam, cooperating with said lever positioning means and defining three levels, a first upper level, corresponding to a position occupied by said date wheel assembly on the 31st of the month, a second median level corresponding to positions occupied by said date wheel assembly when the units figure of the date is equal to zero, or comprised between 2 and 8, or when the units figure is equal to 1 and the tens figure to 0, 1 or 2, and a third lower level, corresponding to a position occupied by the date wheel assembly when the units figure is equal to 9;

a drive unit for said wheel with twelve teeth secured to said second member provided with a drive finger and a star wheel with ten teeth and driven by one step per day by said third drive means of said lever, with the exception of the day when said positioning means abut against said upper level of said cam, and arranged so that said finger drives said wheel with twelve teeth secured to said second member when the units figure of the date is equal to 9;

a retrograde unit for the tens including another wheel with 31 teeth, kinematically connected to said wheel with 31 teeth of the date wheel assembly, actuated when said lever positioning means abut against said upper level of said cam;

a return spring of said second member, wound each time that said drive unit moves said second member forward and let down when said retrograde unit is actuated; and a drive lever, secured in rotation to said first member and cooperating with said fourth drive means, to cause said wheel with twelve teeth secured to said first member to move forward three steps each time that said positioning means of said lever abut against said lower level of said cam.

* * * * *